United States Patent [19]

Eisele et al.

[11] 4,426,980

[45] Jan. 24, 1984

[54] CORRECTION DEVICE FOR A FUEL METERING SYSTEM IN AN INTERNAL COMBUSTION ENGINE

[75] Inventors: Hermann Eisele, Vaihingen; Gerhard Stumpp, Stuttgart; Wolf Wessel, Oberriexingen; Ulrich Flaig, Markgröningen; Fridolin Piwonka, Tamm., all of Fed. Rep. of Germany

[73] Assignee: Robert Bosch GmbH, Stuttgart, Fed. Rep. of Germany

[21] Appl. No.: 479,769

[22] Filed: Mar. 28, 1983

Related U.S. Application Data

[63] Continuation of Ser. No. 247,025, Mar. 24, 1981, abandoned.

[30] Foreign Application Priority Data

Mar. 26, 1980 [DE] Fed. Rep. of Germany ..... 3011595

[51] Int. Cl.[3] ..... F02D 11/16

[52] U.S. Cl. ..... 123/478; 123/352; 123/350

[58] Field of Search ..... 123/478, 480, 511, 512, 123/445, 446, 350, 352, 357, 359

[56] References Cited

U.S. PATENT DOCUMENTS

| | | | |
|---|---|---|---|
| 3,767,972 | 10/1973 | Noddings et al. | 123/352 |
| 4,113,046 | 9/1978 | Arpino | 123/352 |
| 4,169,437 | 10/1979 | Fleischer | 123/352 |
| 4,190,026 | 2/1980 | Sakakibara | 123/352 |
| 4,211,193 | 7/1980 | Cox et al. | 123/352 |
| 4,217,862 | 8/1980 | Rort et al. | 123/478 |
| 4,245,604 | 1/1981 | Labitt | 123/478 |
| 4,296,722 | 10/1981 | Furabashi et al. | 123/478 |
| 4,309,971 | 1/1982 | Chiesa et al. | 123/478 |
| 4,343,274 | 8/1982 | Butscher | 123/359 |
| 4,353,339 | 10/1982 | Collonig | 123/350 |

*Primary Examiner*—Raymond A. Neill
*Attorney, Agent, or Firm*—Edwin E. Greigg

[57] ABSTRACT

A device is proposed for drift compensation in fuel metering systems, in which it is not the metered quantity as such which is controlled in closed-loop fashion, but rather only the position of a quantity-determining member. The object of the invention is to maintain or re-obtain the original association between the fuel quantity and the position signal of the quantity-determining member for the purpose of providing a correct indication of the load state existing at a particular time. The drift compensation is intended to be capable of being performed manually, semi-automatically, or automatically, in an additive and/or multiplicative manner. It can furthermore be realized via a preferably rpm-dependent characteristic curve. The various values may be ascertained, for instance, in connection with running-out and running-up tests.

7 Claims, 6 Drawing Figures

CORRECTION DEVICE FOR A FUEL METERING SYSTEM IN AN INTERNAL COMBUSTION ENGINE

This is a continuation of application Ser. No. 247,025, filed Mar. 24, 1981 now abandoned.

BACKGROUND OF THE INVENTION

Known fuel metering systems control the quantity of fuel to be metered in open-looped fashion, in accordance with operating characteristics such as load, rpm, and temperature. Closed-loop controlled metering systems are also known, but this closed-loop control has not been carried out to the full extent possible; that is, it is not the metered fuel quantity itself which is measured and processed as a feedback signal, but rather only a position signal, relating, for instance, to the position of the control rod. The assumption in such a system is that this positional signal is sufficient to characterize the particular quantity of fuel metered at a particular time. In closed-loop control systems which function mechanically, this assumption is justified, considering the tolerances which exist in a mechanical system. With electronic systems, however, the signal processing is extremely precise and is also substantially independent of the effects of aging, where errors deriving from worn purely mechanical components may have an interfering effect. These mechanical errors occur especially in high-pressure injection systems, such as those used for Diesel engines, and they are caused by effects which are generally described as "aging". Examples of such aging effects are a relaxation of compression springs, wearing down of control edges and the like. All of this can cause imprecise control of the fuel quantity, so that the position of the control rod, for instance, is no longer an exact standard for the quantity of fuel needed.

Such effects of aging are of only lesser importance in terms of the driving behavior per se of a vehicle, because the driver of an appropriately equipped vehicle, as a rule, is interested only in a particular speed of the vehicle, and this is attained by pressing down to a greater or lesser extent on the accelerator pedal.

These errors become problematical when the positional signal of a quantity-determining member and a metered fuel quantity are to be associated; such as, whenever either the initial setting signals for this quantity-determining member or the positional signal picked up from a travel transducer controls further units of the system in an open-loop fashion. As example of this is exhaust recirculation in the partial load range. Thus, it can happen that the positional signal is signalling a partial load state on the part of the internal combustion engine, and feedback of exhaust gas is desired only in this operational state, but the metered fuel quantities may already correspond to full-load operation. The consequences of this are impermissibly high emissions of toxic substances.

A further consideration, when there is an incorrect relationship between the positional signal and the metered fuel quantity, is inconsistency of the rated output of the engine. An illustration of this is the case where more fuel is needed with aging on the part of the injection pump, allowing the engine to attain a higher output than that originally intended, which may have unintended consequences in terms of control.

OBJECT AND SUMMARY OF THE INVENTION

It is an object of the invention to prevent any restriction in the functioning of highly precise electronic systems as a result of changes in purely mechanical structure components due to aging of elements.

It is a further object of the correction device for a fuel metering system in an internal combustion engine according to the invention to have the metering device function extremely precisely over the course of a long period of service.

It is a still further object of the invention to have the metering device always return once again to this correct functioning.

It is yet another object of the invention to provide that this correction is attained with means which are under some circumstances quite simple.

The invention will be better understood and further objects and advantages thereof will become more apparent from the ensuing detailed description of preferred embodiments taken in conjunction with the drawings.

DESCRIPTION OF THE EXEMPLARY EMBODIMENTS

The embodiments described herein refer to applications to a Diesel engine. However, the invention is not restricted to such an engine; indeed, it is applicable wherever the metered fuel quantity is determined by a corresponding mechanical adjusting member. This pertains accordingly to controlled carburetor systems and gasoline injection systems as well.

Figure 1:
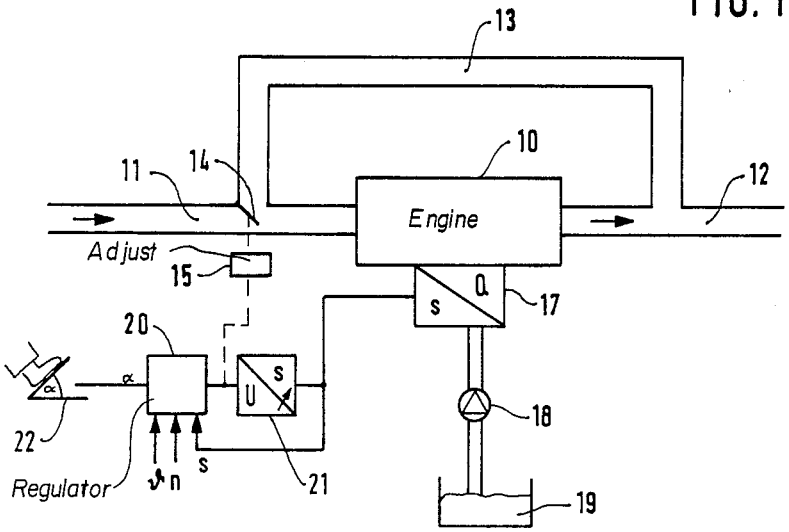
FIG. 1 is a schematic circuit diagram of a fuel metering system in an internal combustion engine having self-ignition.

FIG. 1 is a general schematic view of an internal combustion engine having self-ignition and having the associated fuel metering systems. The internal combustion engine 10 is supplied with fresh air via an air intake tube 11, and its exhaust line 12 has a recirculation line 13. The component of exhaust gas in the cylinder charge as a whole can be adjusted by means of a mixture valve 14 (valve and throttle valve), which is controllable via an adjusting member 15 of known design, such as shown as element 51 in U.S. Pat. No. 4,040,394 or element 34 in U.S. Pat. No. 4,333,439.

A fuel pump 17 receives the fuel from a pump 18 out of a tank 19. The quantity of fuel to be injected at a particular time is determined by the position of a control rod or a control slide, which will be described hereinafter as a quantity-determining member. This member is illustrated symbolically by a travel/fuel quantity converter (s/Q). The position of the quantity-determining member in turn is initially adjusted via an adjusting regulator inside a regulator 20 of known design, such as shown at 31 in U.S. Ser. No. 228,399, now U.S. Pat. No. 4,359,991, preferably by means of an electromagnetic control element 21 of known design, such as shown in FIG. 1 of U.S. Pat. No. 4,242,606, and, which is symbolically indicated as a voltage/travel converter (U/s). The input variables for the regulator 20 are, first, a signal from an accelerator pedal 22, an rpm feedback signal, and a position feedback signal pertaining to the position of the control rod.

As a rule, the regulator 20 has an integrated function, so that in the pertinent control loop there are no enduring control deviations. For this reason, for instance during engine idling, precise initial regulation can be effected by correcting the quantity of fuel to be injected until a level corresponding to the desired idle rpm has been attained. In accordance with the quantity which is then required, the position of the quantity-determining member is altered, and a signal that this position has been attained is fed back in turn to the regulator 20. The adjusting member 15 for the mixture valve 14 in FIG. 1 is controlled, in open-loop fashion, by the set-point value or actual value of the position of the quantity-determining member, among other factors. If the relationship of this position to the injected fuel quantity is allowed to vary as a result of aging effects in the fuel pump 17, then at a predetermined load/rpm point, a positional signal for the quantity-determining member is present in the regulator 20, which is at odds with its corresponding rated value; as a result, the position of the mixture valve 14 is no longer that which was initially adjusted. The rpm may be maintained correctly, independently for this variation, with a closed control loop having an integral component. However, the exhaust feedback rate is no longer correct, and thus the exhaust emissions deteriorate. Incorrect control of this kind is not supportable in view of present day exhaust regulations and those to be expected in the future.

Similar changes in the relationship between the control rod position and the injected fuel quantity can also be caused by a relaxation on the part of restoring springs or by increasing wear of control edges. All of these deviations are typically called "drift" for the sake of simplicity, and the counter-measures required are called "drift compensation".

As has already been noted, the individual errors cause a change in the relationship between the position of the quantity-determining member and the injected fuel quantity. The object of drift compensation is to vary the relationship between the positional signal and the position of the quantity-determining member in such a way that the original relationship between the position signal and the injection quantity is either brought about once again or maintained without deterioration. A superimposed rpm control loop having an integral component immediately compensates for this variation, because an appropriately adapted value is furnished on the basis of the integral component of the regulator.

Figure 2:
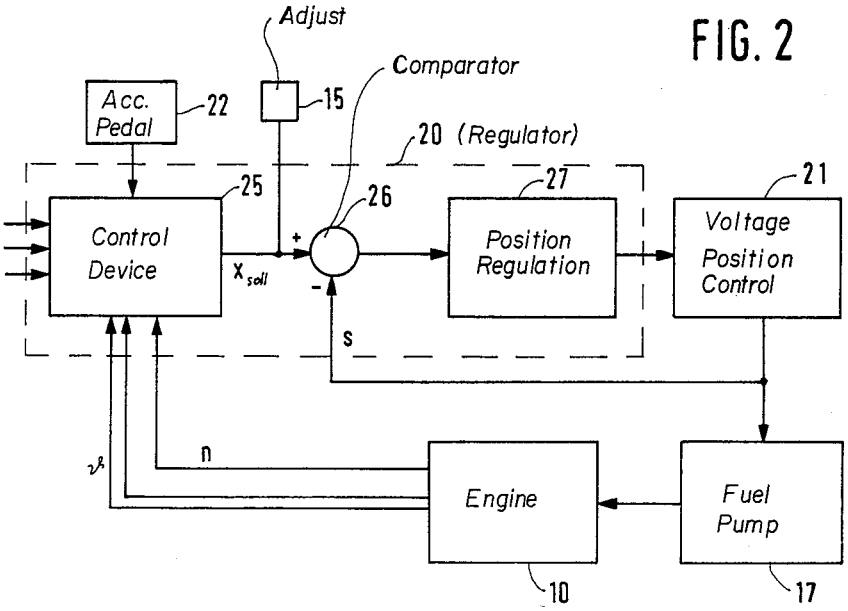
FIG. 2 shows schematically the fundamental structure for the closed-loop control of injection quantities.

FIG. 2 shows the basic structure of such a closed-loop injection quantity control, enlarged in scale somewhat in comparison with the representation in FIG. 1. Identical structural components and control units are given identical reference numerals. The regulator 20, however, is shown subdivided into components including a control device 25 such as shown at 35 in U.S. Ser. No. 228,399 and such as shown as element 27 in FIG. 1 of U.S. Pat. No. 4,294,211, a subsequent comparator 26, and a position regulator 27 such as shown in FIG. 1 of U.S. Pat. No. 4,292,658. The control device 25 generates a set-point position signal, which is compared with the actual position signal of the quantity-determining member, and an adjusting signal generated by a position regulator 27 in accordance with this closed-loop comparison between set-point and actual values. This position regulator 27 contains an integrated component as part of its closed-loop control mode, so that enduring control deviations do not occur.

Where there is severe drift on the part of the injection pump, the relationship between the control rod position and the injected fuel quantity is no longer correct. As a result, a control rod position variance is produced for a predetermined rpm at the same load and thus for a predetermined fuel quantity, and this control rod position is finally maintained by the position regulator 27. It is an object of drift compensation to re-obtain the originally correct feedback voltage from the position transducer to the control element 21 in the case where pump output has changed, so that the original relationship between the positional signal and the quantity of fuel supplied is reestablished.

In order to provide drift compensation for the pump or the control element, the assumption is that at a particular operation point of the engine, and under well-defined peripheral conditions, the quantity of fuel needed is substantially independent of the age of the fuel metering system. An operational state of the engine which is extremely well suited for this purpose is idling, because at idle both the load (zero load) and the rpm are determined wholly by the system itself. Additional measures such as intermediate rpm control and the application of a definite external load naturally also represent other engine operational states which may be used for retroactive calibration of the pump.

Drift may have an additive effect and/or a multiplicative effect. The additive drift compensation is particularly simple, because in this case only a single operational state is being sought. Compensation is then effected in such a state with the aid of this defined operational point in the engine characteristic curve, thus the performance graph describing the relationship between the injection quantity and the position of the quantity-defining member is shifted in parallel, that is, additively, until the signal is equal to the set-point signal originally pertaining to this operational point. An electrical compensation (exerting the influence of the signal voltage) can be effected precisely, however, without additional means only if the transducer has a linear characteristic curve.

Retroactive adjustment in multiplicative fashion always requires choosing two operational points. Thus, the evaluation circuitry or signal processing of the transducer itself, is adjusted in such a manner that the signal difference between these chosen operational points is adjusted to the corresponding set-point signal difference.

Various possible embodiments will now be described with the aid of FIGS. 3 through 6 for the retroactive calibration or drift compensation of the injection system. The specific individual embodiments relate, by way of example, to an injection pump whose electrical control element 21 has a semi-differential short-circuit ring transducer (short-circuit ring transducer with an adjustable reference inductivity) for feedback purposes.

Figure 3:
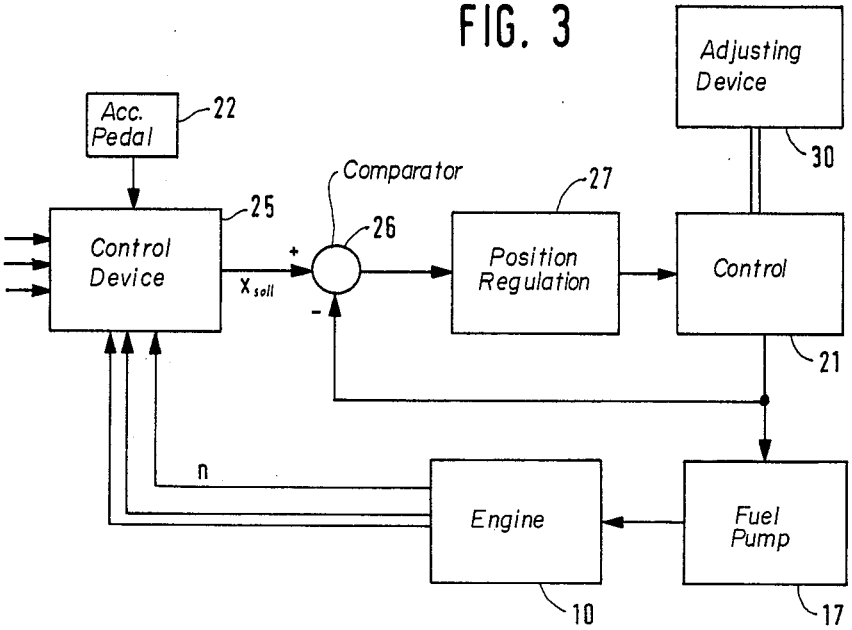
FIG. 3 is illustrative of one possible embodiment of a correction device following the invention.

In comparison with the layout shown in FIG. 2, the embodiment of FIG. 3 has an adjusting device 30 to associate the transducer and the control element, so that the original feedback signal can be initially set for a predetermined injection quantity. This adjusting device 30 must permit the orientation of the control element or the control rod to the position transducer (additive compensation) or must permit the variation of the so-called transducer factor (for multiplicative compensation) while the engine is running.

For the purpose of drift compensation, this orientation or association of factors is shifted, during closed-loop rpm-controlled operation at idle (LL-point) until the actual value or set-point value at the position regulator 27 (both values being equal, because of the integral component in the position regulator 27) have a value corresponding to the test operational point (in this case, the LL point). Since in the course of retroactive adjustment the rpm control loop must not be interrupted, when using a semi-differential short-circuit ring transducer as a feedback element, it is effective for the core or the unit as a whole (core with electromagnetic control element) to be moved below the short-circuit ring, functioning in a contact-free manner. To this end, the unit to be adjusted must be capable of being displaced by an adjusting screw in the required retroactive adjustment range. Such adjustment is effected in a rotary fashion when the control element is a rotary element, and is done in translational fashion in the case of a control element which executes a stroke.

This method is theoretically the correct method for performing an additive compensation. Because the drift caused in this case by "settling" of the pump is retroactively compensated for directly at the point where it occurs, this method is also correct in the case of a non-linear characteristic transducer.

A retroactive multiplicative adjustment by simple means is possible only if a sufficiently linear characteristic transducer curve is present. In that case, the retroactive adjustment is effected by adjusting the reference short-circuit ring on the semi-differential short-circuit ring transducer.

Mechanical compensation in the pump involves substantial expense, because there is so much stress due to shaking and because of the overpressure in the pump. An electrical means of retroactive adjustment is therefore more favorable in cost.

Figure 4:
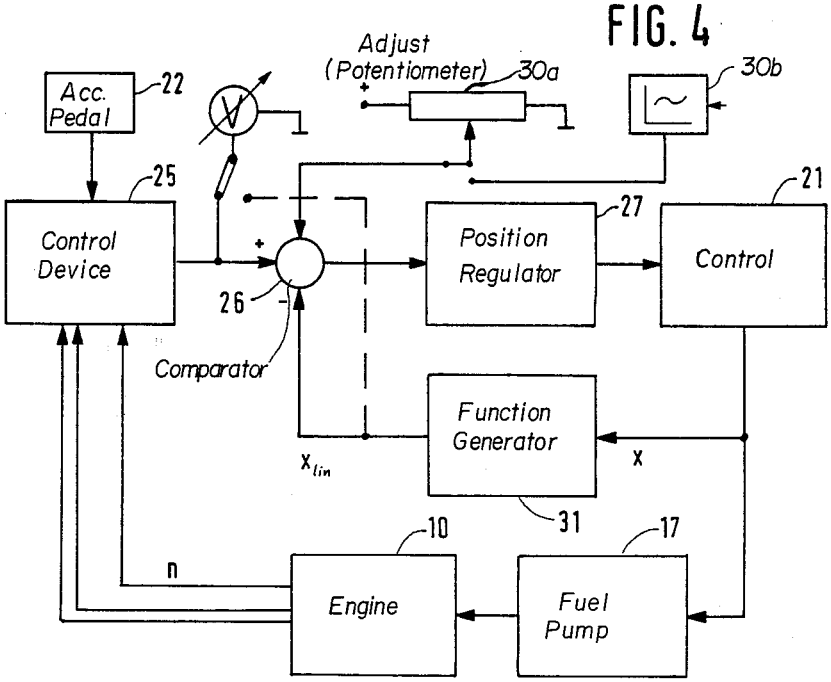
FIG. 4 is illustrative of another possible embodiment of the correction device following the invention.

In accordance with FIG. 4, the electrically simple, additive correction is effected by a variable signal, a so-called offset signal, which can be switched to the point of comparison 26. In electrical terms, this intervention made in the comparison betweeen set-point and actual values represents a fictional variation of the feedback signal.

This intervention can be realized by means of a potentiometer 30*a* between the terminals for operational voltage with the slide of the potentiometers being coupled to one input of a comparator 26.

The method above described for additive, electrical retroactive adjustment for the purpose of compensating for additive drift in fuel quantity is correct only when the characteristic transducer curve is linear. Only then can a drift in the characteristic cure in the abscissa direction be compensated for by displacement in the ordinate direction. The method is suitable for a non-linear transducer characteristic curve only if the transducer signal has been linearized by a function generator 31 such as disclosed in U.S. Ser. No. 228,399 before it is fed back to the comparison point; thus, in principle, it is suitable only when the measuring system used functions in linear fashion. The function generator 31 may be represented, by way of example, by a diode-amplifier network.

The schematic of FIG. 4 functions with analog signal voltages. To achieve interference-free operation and for the realization of complex regulation processes, closed-loop control systems which function digitally are increasingly being used, and such systems then require a corresponding modification of the embodiment of FIG. 4.

Figure 5:
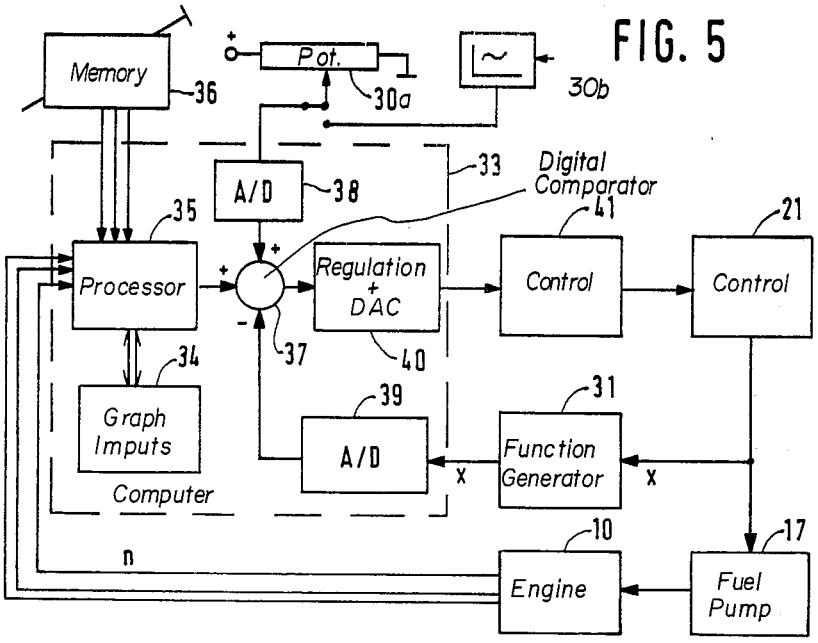
FIG. 5 is illustrative of still another possible embodiment of the correction device following the invention.

FIG. 5 shows one example of drift compensation for a computer-controlled closed-loop control element system. The computer 33 includes performance graphs 34 as described at 14 in U.S. Pat. No. 4,265,200 and a performance graph processing circuit 35, such as shown at 15 in U.S. Pat. No. 4,265,200, both of which may be furnished with operating characteristics of the engine and, as needed, values from an external memory 36. The comparator circuit 37 functions digitally in this instance, so that one analog-digital converter 38 and 39 must be inserted into each of the signal lines leading from the potentiometer 30 and from the function generator 31. The digital comparator circuit 37 leads to a regulator 40 having an associated digital-analog conversion, then to an output circuit 41 providing the trigger signal for the control element 21. For further description of these circuits, see U.S. Pat. Nos. 3,796,197 and 4,292,658. In the U.S. Pat. No. 3,796,197 a detailed construction is shown of an analog version of an electronic regulator with fuel injection control for Diesel engines (FIG. 1) which corresponds to the regulator 40 and output circuit 41 of the present invention. In U.S. Pat. No. 4,292,658 (FIG. 2) the elements 20 and 26 correspond to elements 40 and 41 of the present invention.

In the embodiment of FIG. 5, drift compensation may be performed by generating the compensation voltage at a potentiometer 30*a* and delivering it via the analog-digital converter 38 to the computer so that it can be processed.

The same effect can be attained with an external digital memory 36 which is operated manually and whose contents are received by the computer 33 via a digital input. Naturally, the digital memory 36 must be protected so that the information contained therein is not lost when the supply of electric current is shut off.

Figure 6:
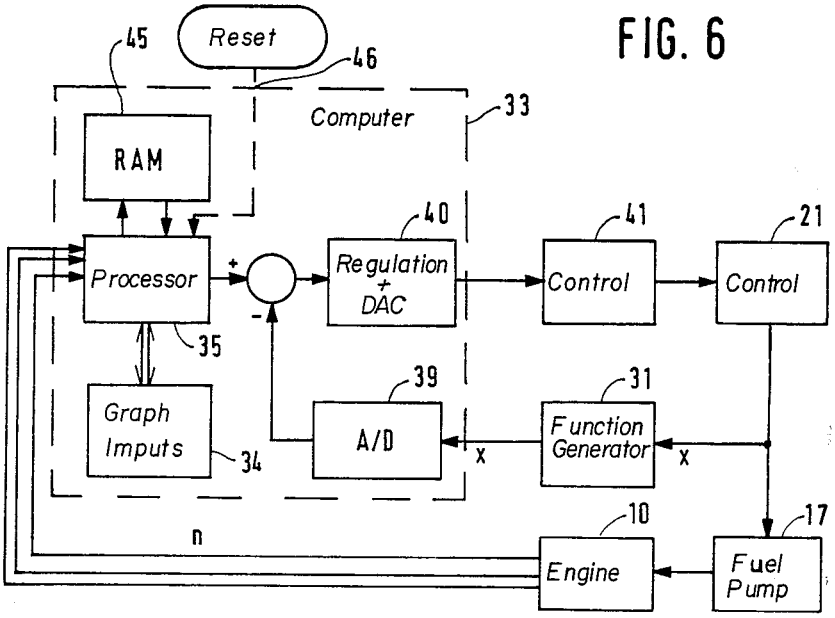
FIG. 6 is illustrative of a still further possible embodiment of the correction device following the invention.

FIG. 6 shows one possible embodiment of a circuit provided with semi-automatic and automatic drift compensation. To this end, a read-write memory 45 is required, which retains its contents even when the electrical current supply is switched off. The compensation itself is then effected in the same manner as has been described above with reference to FIG. 5.

The invention also comprehends a method in which the operational point of compensation (the pre-defined operational parameter) is set during servicing or repair, and then the servicing team appropriately resets the offset memory. This action would be controllable via one input 46 of the computer 33.

For fully automatic drift compensation, the system itself must first recognize a pre-defined operational point suitable for performing a proper compensation, and then must undertake compensation itself. In a well-equipped closed-loop control system, this means that little additional hardware is needed except for the read-write memory 45 with the devices required therefor, because the important input data such as engine temperature, air ratio, and so forth, are detected by measurement means in any case, and are available for use in the control unit.

The core of the invention described above provides for a retroactive calibration of the drift control chain (control element regulator, control element and injection pump) effected either manually, semi-automatically, or automatically, as follows: At one or more selected operational points having an rpm which is controlled in closed-loop fashion to a constant value and with a fuel quantity requirement which is constant and known in terms of engine specifications (for instance, LL-point), the original adjustment signal is reestablished by means of a displacement of the characteristic curve. In this fashion, an error in the control chain having to do with the relationship between the adjusting position and the fuel quantity, which may have arisen as a result of drift, is eliminated even in cases where the rpm is not controlled in closed-loop fashion, such as in the case of exhaust recirculation, temperature-dependent starting, etc.

The mode of operation described above is successful only when all other external circumstances are truly unchanged and correspond to the rated status of the engine which has been put into operation. It is also presumed that the drift in the relationship between the injection quantity and the position of the quantity-determining member is independent of rpm.

If the drift is dependent on the rpm but is not dependent on load, then an rpm-dependent characteristic curve can be used for compensation purposes in making the transition from the set-point value of the injection quantity to the position of the quantity-determining member.

In order to initially establish this rpm-dependent characteristic curve, not only the LL point but the total zero-load line as well (given sufficient critical points) is measured. The individual intermediate rpm values are established and regulated with an intermediate-rpm regulator having an integral component, so that no enduring control deviation appears. The characteristic correction curve is then initially established in such a way that at each critical point the original relationship exists between the injection quantity and the position signal of the quantity-determining member.

Thus, in FIGS. 4 and 5, the blocks 30*a* can be replaced by a characteristic curve generator 30*b*, which in an rpm-dependent fashion switches the drift correction signal to the comparison point or switches it digitally in the region of the performance graph processing.

The hypothesis in the case of all of these drift compensation means is that the specific fuel consumption of the engine during the adjustment process remains unchanged relative to the set-point status of the engine. The specific fuel consumption (the fuel mass applied relative to the mechanical energy produced) depends more or less, however, on the following parameters: Oil temperature, fuel temperature, water temperature, type of oil, fuel values, and frictional moment (internal brake moment).

The fuel temperature is measured in any case by the fuel metering system and its value can be compensated for. The oil temperature, oil type and water or engine temperature may be pre-defined at a reasonable expense for compensation purposes or can be held constant to predefined values. The influence of the fuel type (heating valve) and friction moment must, however, be ascertained and taken into consideration in the initial setting of the drift compensation value.

To this end, the following method is proposed:

(A) In a running-out test, the rpm-dependent internal brake moment $M_B(N)$ is ascertained. Then, at the rated rpm and zero load, the injection quantity is abruptly set to zero, so that the engine slows, as a result of its internal braking moment, down to zero rpm. The following formula applies:

$$\dot{N} = \frac{K}{\theta} M_B(N)$$

K is a system constant; $\theta$ is the inertial moment of the engine; and N is detectable by measurement techniques as a function of N, so that $$M_B(N) = \dot{N}(N) : \frac{K}{\theta}$$

can be determined.

(B) The influence of the fuel type and in general additive drift can be ascertained at a known braking moment MB (N) by means of a running-up test. In this case, the hypothesis is that the control computer for this process can initially provide a pre-defined set-point quantity jump $\Delta Q_K$. The following course of rpm is then produced:

$$\left( Km = \frac{M_{MOT}}{Q_K}(N) \right)$$

$$\dot{N} = (Km(N) \cdot Q_K - M_B(N))$$

The influence of the fuel type can then be identified on the basis of the deviation of the set-point running-up curve, corrected with the influence of the actual braking moment, from the running-up curve which is actually measured.

The influence exerted by the actual fuel type and the actual internal braking moment can thereby be taken into consideration in the ascertainment of the compensating characteristic curve which is ascertained with the aid of the zero-load line or in ascertaining a compensating value, with the aid of the idle point.

The foregoing relates to preferred exemplary embodiment of the invention, it being understood that other embodiments and variants thereof are possible within the spirit and scope of the invention which is defined by the appended claims.

What is claimed and desired to be secured by Letters Patent of the United States is:

1. A drift-compensation correction device for controlling a fuel metering system having a fuel pump in an internal combustion engine in which there is an incorrect relationship between a fuel metering signal and metered fuel quantity due to fuel pump aging, comprising:

means for generating set-point data signals responsive to operating parameters of said engine, said data signals including a drift signal corresponding to said incorrect relationship, means responsive to a final control element in said fuel metering system for generating actual data signals, a comparator means for comparing said actual and set-point signals, a regulating means responsive to said comparator means for providing said fuel metering signal to said final control element via an output circuit means for determing said quantity of fuel to be metered to said pump, and means supplying a correction intervention signal to said fuel metering signal corresponding to said drift signal, whereby the effect of drift in said set-point generating means due to aging of said pump is compensated for and said set-point generating means is restored to its original output rating value.

2. A correction device as defined by claim 1, wherein said corrective intervention signal being effected semi-automatically.

3. A device according to claim 1, wherein said correction intervention signal means comprises a potentiometer.

4. A device according to claim 1, wherein said correction intervention signal means comprises a characteristic curve generator, preferably rpm-dependent.

5. A device according to claim 1, wherein said fuel metering signal is additively corrected by said comparator means.

6. A correction device according to claim 1, wherein said correction intervention signal is applied to said fuel metering signal at said comparator means.

7. A correction device according to claim 1, wherein said correction intervention signal is applied to said fuel metering signal at said set-point generating means.

* * * * *